United States Patent [19]

Hisano et al.

[11] 4,401,411

[45] Aug. 30, 1983

[54] DEVICE FOR CONNECTING TURBINE BLADES

[75] Inventors: Katsukuni Hisano; Kazuo Ikeuchi; Makoto Nishimura; Hazime Sibaoka, all of Hitachi; Kiyoshi Namura, Ibaraki; Akira Isida; Katsumi Oyabu, both of Hitachi, all of Japan

[73] Assignee: Hitachi, Ltd., Tokyo, Japan

[21] Appl. No.: 270,599

[22] Filed: Jun. 4, 1981

[30] Foreign Application Priority Data

Jun. 4, 1980 [JP] Japan ..... 55-74367

[51] Int. Cl.[3] ..... F01D 5/22; F01D 25/04

[52] U.S. Cl. ..... 416/196 R; 416/195; 416/500

[58] Field of Search ..... 416/196 R, 190, 191, 416/195, 500

[56] References Cited

U.S. PATENT DOCUMENTS

| | | | |
|---|---|---|---|
| 3,572,968 | 3/1971 | Musick | 416/190 |
| 4,028,007 | 6/1977 | Kuroda et al. | 416/191 |
| 4,257,742 | 3/1981 | Ogata et al. | 416/196 R |

FOREIGN PATENT DOCUMENTS

| | | | |
|---|---|---|---|
| 56-32003 | 1/1981 | Japan | 416/196 R |

*Primary Examiner*—Harvey C. Hornsby
*Assistant Examiner*—Shewen Bian
*Attorney, Agent, or Firm*—Antonelli, Terry & Wands

[57] ABSTRACT

A device for connecting the turbine blades of a turbine having a plate-shaped member provided at the radially outer end of each turbine blade and extended substantially at a right angle to the longitudinal plane of the turbine blade. The plate-shaped member is projected from the leading and trailing edges of the turbine blade, and is provided with through bores formed in each projected portion. Connecting members having cylindrical pins or the like projections are disposed between two adjacent turbine blades in such a manner that the projections are rotatably received by respective through bores. Namely, one of the connecting members is connected to the plate-shaped member of the leading edge of the turbine blade while the other connecting member is connected to the plate-shaped member of the trailing edge of the preceding adjacent turbine blade. The connecting members are disposed such that they partially underlie the plate-shaped members of the adjacent turbine blades and that they make contact with each other during the running of the turbine thereby to restrict the untwisting of the turbine blades while attaining a vibration damping effect.

13 Claims, 8 Drawing Figures

DEVICE FOR CONNECTING TURBINE BLADES

BACKGROUND OF THE INVENTION

The present invention relates to a device for connecting adjacent turbine blades of turbine wheel such as steam turbines, gas turbines and so forth.

The specification of the U.S. Pat. No. 3,302,925 discloses a device for connecting adjacent turbine blades, particularly long turbine blades which is twisted over the entire lengths from the base to the end, of the turbine wheel in a vibration damping manner. In this known connecting construction, each turbine blade is provided with holes at the leading and trailing edges of the radially outer end thereof. A turbine blade cover having horizontal projections from both sides thereof, one of these horizontal projections being fitted in the hole of the trailing edge of the preceding turbine blade and caulked firmly therein, while the other projection is loosely received by the hole in the leading edge of the following moving blade, thereby to connect these two turbine blades.

Various studies have been made as to the behaviour of the turbine blades connected by the above-explained conventional connecting device. It has become clear, as a result of these studies, the turbine is seriously affected by a phenomenon of untwisting of the turbine blades due to the centrifugal force during operation of the turbine.

More specifically, during the operation of the turbine, a centrifugal force is applied to each turbine blade to generate an untwisting force or moment M on the turbine blade. This untwisting moment M is born by a counter moment M produced in the turbine blade cover by which the turbine blades are restricted. Namely, the untwisting of the turbine blade is restricted by the presence of the horizontal projections of the associated turbine blade cover. This means that an excessively large force is applied to the projections of the turbine blade cover, as well as a large bending moment. In consequence, there is a fear that the projections may be broken during the rotation of the turbine blade wheel, resulting in a serious accident. Thus, the conventional construction for connecting the turbine blades involves a serious problem concerning the reliability of the turbine blades.

SUMMARY OF THE INVENTION

Accordingly, an object of the invention is to provide a device for connecting adjacent turbine blades, having a high mechanical reliability and capable of effectively restricting the untwisting of the turbine blades while damping the vibration of the same.

To this end, according to the invention, there is provided a connecting device for connecting adjacent turbine blades, the device comprising a plate-shaped member provided at the radially outer end of each turbine blade in such a manner as to project beyond the leading and trailing edges of the turbine blade, and a plurality of connecting members adapted to engage the plate-shaped members of adjacent turbine blades, one of said connecting members engaging the plate-shaped member projected from the leading edge of the following turbine blade while the other of the connecting members engages the plate-shaped member projected from the trailing edge of the preceding turbine blade, the connecting members being adapted to make contact with each other during the rotation of the turbine wheel to connect the preceding and following turbine blades to each other thereby to restrict the turbine blades against the untwisting while achieving damping of vibration.

The above and other objects, as well as advantageous features of the invention will become clear from the following description of the preferred embodiments taken in conjunction with the accompanying drawings.

DESCRIPTION OF THE PREFERRED EMBODIMENT

Figure 1:
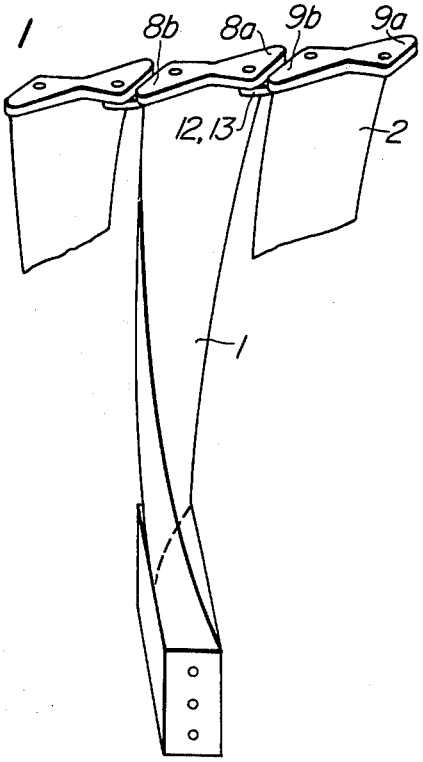
FIG. 1 is a perspective view of a turbine blade of a steam turbine, adapted to be connected to the adjacent turbine blades by means of a connecting device in accordance with the invention.

A turbine blade connecting device for turbines, constructed in accordance with an embodiment of the invention, will be described hereinafter with reference to the accompanying drawings.

Referring to the drawings, there is shown turbine blades 1, 2 of a turbine. Each of the turbine blades is twisted over its length from the base end to the radially outer end of the same. These turbine blades are connected in a vibration damping manner by means of a connecting device 12, 13 which are secured to the lower sides of plate shaped projections 8*a*, 9*b* formed at the radially outer ends of the turbine blades 1, 2.

Figure 3:
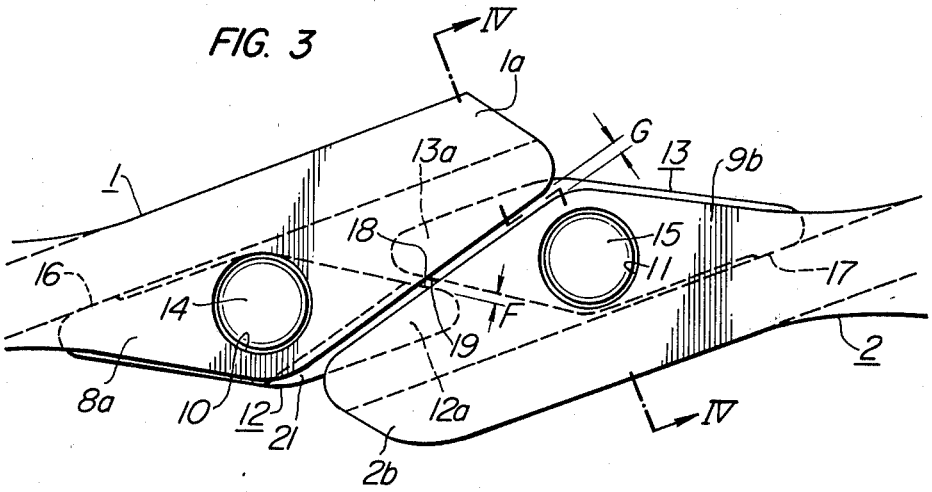
FIG. 3 shows the turbine blade connecting device of an embodiment of the invention in the stationary state of the turbine wheel, as viewed from the radially outer side of the wheel.
Figure 2:
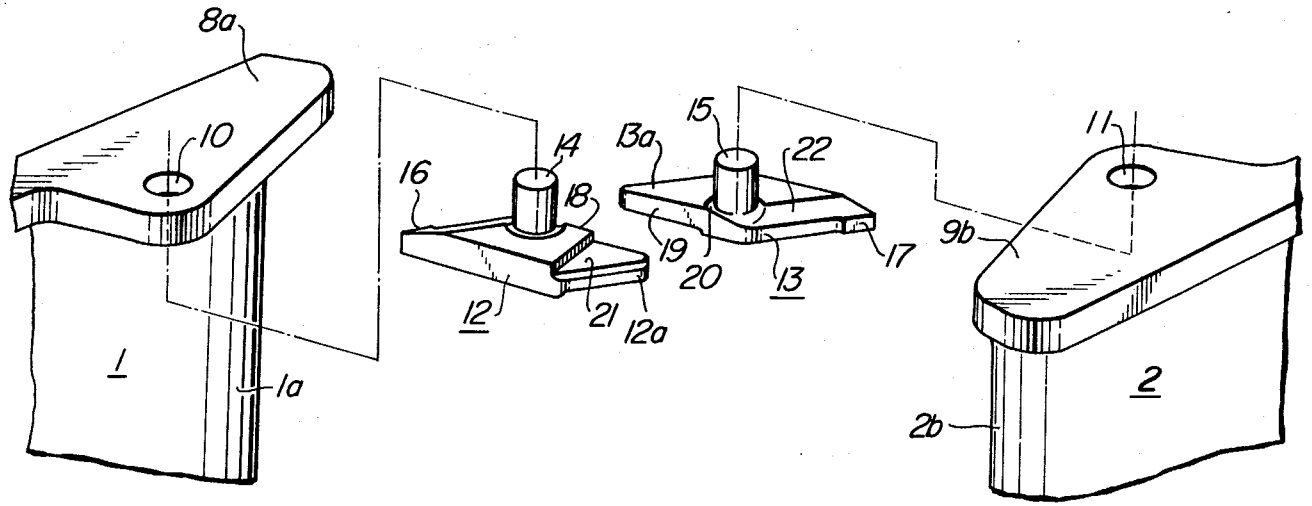
FIG. 2 shows how the turbine blade connecting device in accordance with the invention is assembled on the turbine blade.

More specifically, referring to FIGS. 2 and 3, the turbine blade 1 has penthouse-like plate-shaped projections 8*a*, 8*b* formed at the radially outer end thereof so as to project horizontally from the trailing edge (steam outlet side) 1*a* and the leading edge (steam inlet side) 1*b* in the opposite directions perpendicularly to the longitudinal axis of the turbine blade 1. The adjacent turbine blade 2 is provided with similar projections 9*a*, 9*b* projecting from the trailing edge 2*a* and the leading edge 2*b* thereof. The plate-shaped projections 8*a*, 9*a* and 8*b*, 9*b* are provided with vertical through bores 10 and 11, respectively. The assembling and adjustment are made such that a slight gap G is preserved between the projection 1*a* of the turbine blade 1 and the projection 2*b* of the turbine blade 2. Between the radially outer ends of the turbine blades 1, 2, disposed are turbine blade connecting members 12 and 13 adapted for damping the vibration of these turbine blades. The connecting members 12, 13, constituting in cooperation a connecting member assembly, are secured to the lower side of the trailing side projection 8*a* of the turbine blade 1 and to the lower side of the leading side projection 9*b* of the turbine blade 2. Cylindrical pins 14, 15 are unitarily formed on the upper faces of the connecting pieces 12, 13, respectively. The pin 14 on the connecting member 12 and the pin 15 on the connecting member 13 are adapted to be fitted in the through bore 10 formed in the projection 8*a* of the turbine blade 1 and in the through bore 11 formed in the projection 9*b* of the turbine blade 2, respectively. Each of the connecting members 12, 13 has a diamond-shaped plan. These connecting members 12, 13 have one ends 12*a*, 13*a* extending to lay under the projections 9*b*, 8*a* of the adjacent turbine blades. The connecting members 12, 13 are provided also with slightly projected contact surfaces 16, 17 at their other ends facing the surfaces of the turbine blades. In the assembled state, the contact surfaces 16, 17 make contact with the surfaces of the turbine blades 1, 2 with a gap F preserved between the ends 12*a*, 13*a* of the connecting members 12, 13. The upper surfaces of the connecting pieces 12, 13 act also as pressure receiving surfaces for contacting the lower sides of the projections 8*a*, 9*b* under application of the centrifugal force.

The construction of the connecting members will be described in detail hereinunder. Referring to FIG. 3 which is a sectional view taken along the line IV—IV of FIG. 4 and to FIG. 5 showing the connecting member 13 before the assembling to the projection 9*b* of the turbine blade 2, the connecting member 13 has a cylindrical pin 15 formed integrally at the center of the upper face of the connecting member 13. This pin 15 is rotatably received by a through bore 11 formed in the projection 9*b* projected from the leading edge of the turbine blade 2. The pin 15 is lightly caulked at its upper end so as not to drop out of the through bore 11. This caulking is essential in order to prevent the connecting member 13 from being dropped from the projection of the turbine blade in the stationary state of the turbine rotor, i.e. the turbine wheel. The end surface of the connecting member 13 facing the blade surface of the turbine blade 2 is chamfered as at 22 in order to clear the corner portion R of the projection 9*b* of the turbine blade 2. Also, an annular groove 20 is formed in the base portion of the pin 15 in order to clear the corner R of the through bore 11 of the projection 9*b*. The chamfer and the groove in combination prevents the local contact of the projection 9*a* to ensure a smooth movement around the pin while ensuring a sufficient strength at the base of the pin 15. Also, at the end of the side surface of the connecting member 13 facing the blade surface of the turbine blade 2, formed is the contacting surface 17 adapted for making a contact with the blade surface of the turbine blade. The connecting member 12 has substantially identical shape as the connecting member 13, unless the step 21 is formed at the end 12*a* thereof.

Hereinafter, a description will be made as to the operation and function of the connecting members during the rotation of the turbine wheel.

Figure 6:
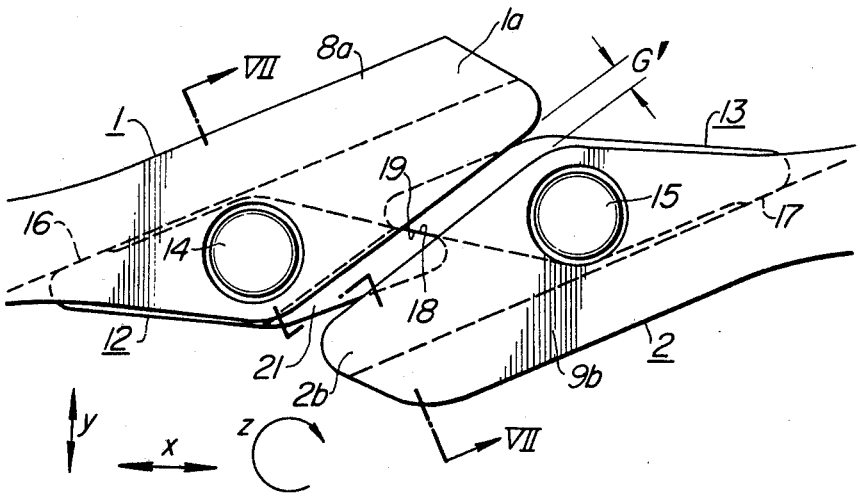
FIG. 6 shows the turbine blade connecting device of an embodiment of the invention in the running state of the turbine as viewed from the radially outer side of the turbine wheel.

FIG. 6 shows the turbine blade as viewed from the radially outer side thereof, in the running state of the rotor, in contrast to FIG. 3 which shows the same portion of the turbine in the stationary condition. During the rotation of the rotor, as a result of the application of the centrifugal force, the turbine blades 1, 2 tend to be untwisted to increase the gap G to G'. This gap G' is determined by the clearance F between the connecting pieces 8, 9 in the state in which the contact surfaces 16, 17 formed at the end surfaces of the connecting members 8, 9 contact the turbine blades 1, 2, respectively, in the state in which the turbine rotor is kept in the stopped state. During the rotation or running of the turbine rotor, the connection surfaces 18, 19 which are the end surfaces of the end 12*a*, 13*a* of the connecting pieces 12, 13 make contact with each other to create the state in which the clearance F is zero, thereby to produce a force for limiting the untwist amounts of the turbine blades to a predetermined range. Namely, during the rotation of the turbine rotor, the connecting members 12, 13 make a slight rotation around the pins 14, 15 to bring the contact surfaces 16, 17 thereof into contact with the surfaces of the turbine blades 1, 2 while allowing the ends of the connecting members 12, 13 contact the connection surfaces 18, 19, thereby to produce the force for limiting the untwisting of the turbine blades.

Figure 4:
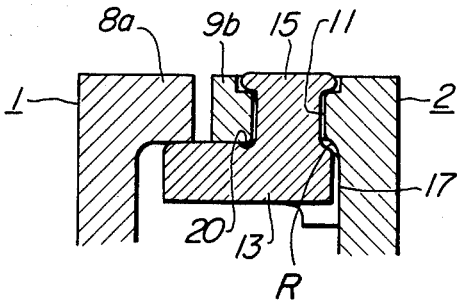
FIG. 4 is a sectional view taken along the line IV—IV of FIG. 3.
Figure 5:
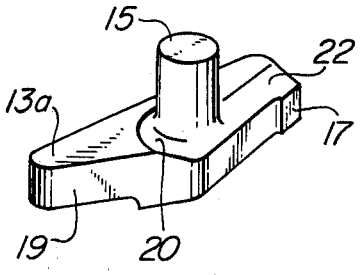
FIG. 5 is a perspective view of the connecting piece shown in FIG. 4.

As will be seen from FIGS. 4 and 5, the contact portion 17 is projected slightly downwardly from the connecting member 13, in order to provide the contact surface 17 with an area ample enough to ensure a sufficiently large strength. Also, the connecting surface 19 is designed to have the required contact area.

Figure 7:
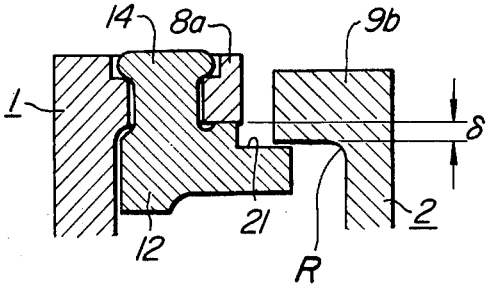
FIG. 7 is a sectional view taken along the line VII—VII of FIG. 6.
Figure 8:
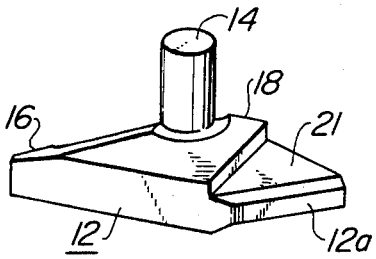
FIG. 8 is a perspective view of the connecting piece shown in FIG. 7.

The centrifugal force acting on the connecting members 12, 13 well reaches 800 Kg at the rated speed of the turbine operation. Since each connecting piece 12, 13 has a diamond-shape, it is possible to preserve a pressure receiving surface on the upper surface of the connecting piece large enough to damp the vibration of the turbine blade. FIG. 7 is a sectional view taken along the line VII—VII of FIG. 6. The radial elongation of the turbine blade at the leading side of the turbine blade due to the centrifugal force is different from that at the trailing side of the same. This will be explained more fully with reference to FIGS. 7 and 8. When the centrifugal forces act on both turbine blades 1 and 2, a difference $\delta$ of elongation is produced between the trailing side projection 8*a* of the turbine blade 1 and the leading side projection 9*b* of the adjacent turbine blade 2. Assume here that the projection 8*a* exhibits a greater elongation than the projection 9*b* of the adjacent turbine blade. In consequence, the end portion of the upper surface of the connecting member 12 engaging with the projection 8*a* tends to contact the projection 9*b* of the adjacent turbine blade to forcibly lift the latter. To avoid this, the end portion of the connecting member 12 adapted to lap the projection 9*b* is lowered by a height corresponding to the difference of elongation from the upper surface of the connecting member 12 constituting the pressure receiving surface, thereby to form a step or recessed area 21. The recessed area 21 is necessary also for absorbing the height difference between the projections 8 and 9 due to error inevitably caused in the course of the mechanical processing and assembling.

The centrifugal force acting on the connecting pieces 12, 13 during the rotation are born at the lower pressure receiving surfaces projections 8 and 9. It is possible to preserve a sufficiently large area by suitably selecting the sizes of the projections 8*a*, 9*b*, as well as the sizes of the connecting members 12, 13. As will be understood from the foregoing description, during the running of the turbine, the force resisting to the untwisting of the turbine blade and the centrifugal force act in combination in the turbine blade connecting device of the invention. According to the invention, since the connecting member assembly engaging the projections of adjacent blades is composed of two separate members 12, 13, the force acting in the connecting device is absorbed by the frictional engagement between the connecting surfaces 18, 19 of the connecting members 12, 13 and, accordingly, can be nullified almost completely.

In the conventional turbine blade connecting device, as stated already, the moment resisting to the untwisting of the blades are born by pins which project from both sides of the turbine blade cover at a right angle to the longitudinal axis of the turbine blades. In contrast, as will be seen from FIG. 6, the force resisting to the untwisting of the turbine blade is born in the connecting device of the invention at the three surfaces of two connecting members 12, 13: namely, the contact surface 17 of the connecting member 13 contacting the turbine blade 2, mutually contacting contact surfaces 18, 19 of the connecting members 12, 13 and the contact surface 16 of the connecting member 12 contacting the turbine blade 1, so that all turbine blades are connected uniformly. If it is desired to impose different loads due to centrifugal force on the leading edge and trailing edge of the turbine blade, it is possible to form the connecting members 12, 13 from different materials. For example, it is possible to make the connecting member 12 from light-weight titanium while forming the connecting member 13 from steel. It is also possible to differentiate the size of these connecting members. The use of the different materials and sizes are allowed thanks to the fact that the connecting members 12, 13 are formed as separate bodies.

Hereinafter, a description will be made as to the vibration damping and restraining effects which are the essential requisites for the device for connecting turbine blades having large lengths.

In the turbine blade connecting device of the invention, the connecting pieces 12, 13 are connected to the adjacent turbine blades through the pins 14, 15, contacting surfaces 16, 17 and the connecting surfaces 18, 19 to resist to the untwisting moment. Assume here that the turbine blade vibrates in the circumferential direction, i.e. in the direction of the arrow x shown in FIG. 6, a small relative vibration takes place the connecting surfaces 18, 19 of the connecting members 12, 13. Thus, the vibration is largely absorbed by the friction between the connecting surfaces 18 and 19.

In contrast, when the turbine blade vibrates in the axial direction, i.e. in the direction of arrow y, the vibration is effectively absorbed by the frictions between the pressure receiving surfaces, i.e. the lower surfaces of the projections of respective turbine blades and the upper surfaces of the connecting members 12, 13.

For the vibration having much greater amplitudes, by preserving the gap G' between the adjacent projections 8*a* and 9*a*, it is possible to stop the movement of the turbine blades 1, 2 toward each other thereby to restrain the vibration of these blades.

As to the vibration in the direction of the arrow z, i.e. in the twisting direction, a large vibration damping effect is achieved by the friction between the connecting surfaces 18, 19 of the aforementioned connecting members 12, 13, the friction due to centrifugal force between the upper pressure receiving surfaces of the connecting members 12, 13 and the lower surfaces of the projections of the blades, and by the friction between adjacent projections of the turbine blades.

Another advantage concerning the vibration is that, by adjusting the gap G between adjacent projections, as well as the clearance F between the connecting pieces, it is possible to adjust the force resisting to the untwisting force, i.e. the rigidity of the outer end portion of each turbine blade to permit the adjustment of the resonance frequency of the turbine blade. This in turn affords quite an effective measure for easily avoiding the resonance vibration of the rotor, to make it possible to operate the turbine at such a speed as to cause a vibration in the turbine blade far from the resonance frequency of the latter, thereby greatly contribute to the enhancement of the safety in the operation of the turbine.

As will be understood from the foregoing description, the turbine blade connecting device of the invention offers various advantages of relieve of the mechanical parts of the device from unreasonable excessive force, absorption of the error inevitable in the production of the turbine blade, easy adjustment of the vibration frequency, and large vibration damping effect in all directions.

Thus, according to the invention, it is possible to obtain a turbine blade connecting device which restricts the untwisting of the turbine blades to damp the vibration of the latter while realizing a high reliability concerning the mechanical strength.

What is claimed is:

1. A device for connecting adjacent turbine blades in a turbine characterized by comprising: a plate-shaped member provided at the radially outer end of each turbine blade and extending substantially at a right angle to the longitudinal plane of said turbine blade and projected from the leading edge and the trailing edge of said turbine blade; and a plurality of connecting members adapted to engage said plate-shaped members, one of said connecting members engaging said plate-shaped member projecting from the leading edge of one of said turbine blades while the other connecting member engages said plate-shaped member projecting from the trailing end of an adjacent turbine blade, said connecting members being so arranged that they partly lap said plate-shaped members of the adjacent turbine blades, sad connecting members being adapted to contact with each other during rotation of the turbine wheel to mechanically connect the adjacent turbine blades of said turbine.

2. A device for connecting adjacent turbine blades of a turbine as claimed in claim 1, wherein each of said plate-shaped members having a through bore adapted to rotatably receive a cylindrical pin formed unitarily with the associated connecting member to protrude from the upper surface of the latter.

3. A device for connecting adjacent turbine blades of a turbine as claimed in claim 1, wherein said plate-shaped member projects beyond the leading edge and trailing edge of each turbine blade, while said connecting members are disposed beneath the projected portions of said plate-shaped member.

4. A device for connecting adjacent turbine blades of a turbine as claimed in claim 1, wherein the distance between the end surfaces of said connecting members is so selected that said end surfaces come into mutual contact when said turbine blades are moved toward each other to leave a predetermined gap therebetween, thereby to preserve the gap between the adjacent plate-shaped members in a predetermined range.

5. A device for connecting adjacent turbine blades of a turbine as claimed in claim 1, wherein said connecting members are so disposed that the adjacent connecting members come into mutual contact when the adjacent turbine blades are moved away from each other to increase the distance between said adjacent turbine blades beyond a predetermined value.

6. A device for connecting adjacent turbine blades of a turbine as claimed in claim 1, wherein each of said connecting member has a protrusion substantially at the center of upper surface thereof, and is provided at the end of the side surface thereof facing the blade surface of said turbine blade with a contact surface for contacting said moving blade.

7. A device for connecting adjacent turbine blades of a turbine as claimed in claim 1, wherein each of said connecting members has a diamond shape so that said connecting members may be covered almost completely by said plate-shaped members of two adjacent turbine blades.

8. A device for connecting adjacent turbine blades of a turbine as claimed in claim 1, wherein each of said connecting members has a step which defines a recessed area underlying said plate-shaped member of the adjacent turbine blades, thereby to allow a difference in elongation by centrifugal force between the leading edge and trailing edge of each turbine blade.

9. A device for connecting adjacent turbine blades of a turbine as claimed in claim 1, wherein at least one of said connecting members is made of a material having a specific weight different from that of the material of said turbine blade.

10. A device for connecting adjacent turbine blades of a turbine as claimed in claim 2, wherein said connecting members are arrayed in the circumferential direction of the turbine rotor in which the ends of said turbine blades are disposed.

11. A device for connecting adjacent turbine blades of a turbine characterized by comprising: a plate-shaped member provided at the radially outer end of each turbine blade and extending substantially at a right angle to the longitudinal plane of said turbine blade and projected from the leading edge and the trailing edge of said turbine blade, each projected portion of said plate-shaped member of each turbine blade has a through bore formed therein; and connecting members having projections rotatably received by said through bores and underlying said plate-shaped members of adjacent turbine blades in such a manner that said connecting members make at their ends mutual contact with each other during running of said turbine to connect the adjacent turbine blades while limiting the distance between the adjacent turbine blades within a predetermined range.

12. A device for connecting adjacent turbine blades of a turbine characterized by comprising: connecting members disposed in the vicinity of the leading edge and the trailing edge of each turbine blade and adapted for engaging said turbine blade, said connecting member engaging said leading edge of said turbine blade has the other end extended toward the trailing edge of the preceding adjacent turbine blade, while said connecting member engaging said trailing edge of said turbine blade has the other end extended toward the leading edge of the following adjacent turbine blade; wherein, when a force is applied during running of the turbine to make the adjacent turbine blades closer to each other, said connecting members act on the adjacent turbine blades to limit the movement of said adjacent turbine blades toward each other to prevent the distance between said adjacent turbine blades from being decreased below a predetermined value, whereas, when a force is applied to move the adjacent turbine blades away from each other, said connecting members do not restrain the movement of said adjacent turbine blades from each other.

13. A device for connecting adjacent turbine blades of a turbine as claimed in claim 12, characterized in that a connecting member engaging one of two adjacent turbine blades and the other connecting member engaging the other of said adjacent turbine blades are disposed in a side-by-side relation.

* * * * *